US009427072B2

(12) United States Patent
Lim

(10) Patent No.: US 9,427,072 B2
(45) Date of Patent: Aug. 30, 2016

(54) SPLIT-TIP APPLICATOR

(71) Applicant: HCT Packaging, Inc., Bridgewater, NJ (US)

(72) Inventor: Cindy Sean Yuei Lim, Santa Monica, CA (US)

(73) Assignee: HCT Packaging, Inc., Bridgewater, NJ (US)

( * ) Notice: Subject to any disclaimer, the term of this patent is extended or adjusted under 35 U.S.C. 154(b) by 0 days.

(21) Appl. No.: 13/751,947

(22) Filed: Jan. 28, 2013

(65) Prior Publication Data

US 2014/0208533 A1 Jul. 31, 2014

(51) Int. Cl.
*A46B 5/00* (2006.01)
*A46B 17/04* (2006.01)

(52) U.S. Cl.
CPC ..... *A46B 5/0054* (2013.01); *A46B 5/00* (2013.01); *A46B 5/0008* (2013.01); *A46B 5/0016* (2013.01); *A46B 17/04* (2013.01)

(58) Field of Classification Search
CPC ..... A46B 2200/1046; A46B 2200/1053; A46B 17/04; A46B 5/0054; A46B 5/00
USPC ..... 15/114, 118, 184, 185, 106; 132/120, 132/126, 135, 148, 218, 313
See application file for complete search history.

(56) References Cited

U.S. PATENT DOCUMENTS 1,748,895 A * 2/1930 Noel ..... 15/167.2
1,914,240 A * 6/1933 Caldwell ..... 15/167.1
2,622,256 A * 12/1952 Vojacek ..... 15/118
2,637,868 A * 5/1953 Hamilton ..... 401/19
2,701,378 A * 2/1955 Dugan et al. ..... 15/111
3,309,728 A * 3/1967 Seaver ..... 15/184
4,204,294 A * 5/1980 Halverson ..... 15/185
4,734,953 A * 4/1988 Dodson ..... 15/106
4,778,300 A 10/1988 French et al.
5,007,442 A * 4/1991 Hirzel ..... 132/218
5,052,839 A 10/1991 Pettengill
5,109,877 A 5/1992 Takeda
5,176,754 A * 1/1993 Hirzel ..... 118/258
5,333,343 A * 8/1994 Nichols et al. ..... 15/106
5,596,785 A * 1/1997 Park ..... 15/114
5,778,479 A 7/1998 Raia (Continued)

FOREIGN PATENT DOCUMENTS

FR 2464674 A * 4/1981 ..... A45D 2/00
WO WO2009031851 A2 3/2009

OTHER PUBLICATIONS

PCT Search Report and Written Opinion mailed Mar. 25, 2014 for PCT application No. PCT/US13/72899, 10 pages.

*Primary Examiner* — Michael Jennings
(74) *Attorney, Agent, or Firm* — Seager, Tufte & Wickhem LLP

(57) ABSTRACT

An applicator system for applying a product includes a handle (e.g., housing) and at least a first applicator and a second applicator. A mechanism, such as a pivot mechanism or a slide mechanism, enables the first applicator and the second applicator to be placed in at least two different positions. In a first position, the first applicator may be aligned with (e.g., adjacent to) the second applicator to define a continuous applicator perimeter that is longer than either the perimeter of the first applicator or the perimeter of the second applicator. In a second position, the first applicator may be positioned at an opposite end of the split-tip applicator relative to the second applicator.

17 Claims, 7 Drawing Sheets

(56) References Cited

U.S. PATENT DOCUMENTS

| | | | | |
|---|---|---|---|---|
| 6,234,181 | B1 * | 5/2001 | Lou | 132/313 |
| 6,418,939 | B1 * | 7/2002 | Byun | 132/313 |
| 6,895,628 | B1 | 5/2005 | Anderson | |
| 6,898,818 | B2 * | 5/2005 | Lin | 15/184 |
| 7,004,913 | B1 | 2/2006 | Rutenberg et al. | |
| 7,228,864 | B2 * | 6/2007 | Tahara | 132/313 |
| 7,234,474 | B2 * | 6/2007 | Byun | A45D 34/02 132/313 |
| 7,246,400 | B2 | 7/2007 | Ryan | |
| 7,316,045 | B2 | 1/2008 | Koke | |
| D568,050 | S * | 5/2008 | Huang | D4/120 |
| 7,653,960 | B2 * | 2/2010 | Lee | 15/184 |
| 7,895,696 | B2 | 3/2011 | Belmonte | |
| 8,032,972 | B2 * | 10/2011 | Cherry | 15/210.1 |
| 8,117,707 | B1 * | 2/2012 | Ruh, II | A46B 5/0012 15/144.1 |
| 8,132,285 | B2 * | 3/2012 | Piao | 15/184 |
| 8,132,541 | B1 | 3/2012 | Baer, Jr. | |
| 8,185,993 | B2 | 5/2012 | Fischer et al. | |
| 8,185,998 | B2 * | 5/2012 | Xu | 15/106 |
| 8,220,100 | B2 | 7/2012 | Diamond | |
| 8,256,058 | B2 | 9/2012 | Telwar | |
| 8,402,592 | B2 * | 3/2013 | Byrne et al. | 15/203 |
| 2003/0066151 | A1 * | 4/2003 | Chang | 15/184 |
| 2007/0124882 | A1 * | 6/2007 | Lee | 15/184 |
| 2010/0017990 | A1 | 1/2010 | Piao | |
| 2012/0017930 | A1 * | 1/2012 | Nance | A45D 19/0008 132/208 |
| 2012/0054971 | A1 | 3/2012 | Dugan | |
| 2013/0111683 | A1 * | 5/2013 | Lim et al. | 15/160 |

* cited by examiner

SPLIT-TIP APPLICATOR

BACKGROUND

Different-sized brushes may be used when applying cosmetic or medicinal products. For example, an individual may select a larger-sized brush to apply foundation to the individual's face to enable the individual to apply the foundation to a relatively large area in a short amount of time. As another example, the individual may select a smaller-sized brush to apply blush or eye shadow to enable the individual to precisely apply the blush to a relatively small area. However, carrying multiple brushes may be inconvenient, particularly when traveling, due to the amount of space taken up by the multiple brushes.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
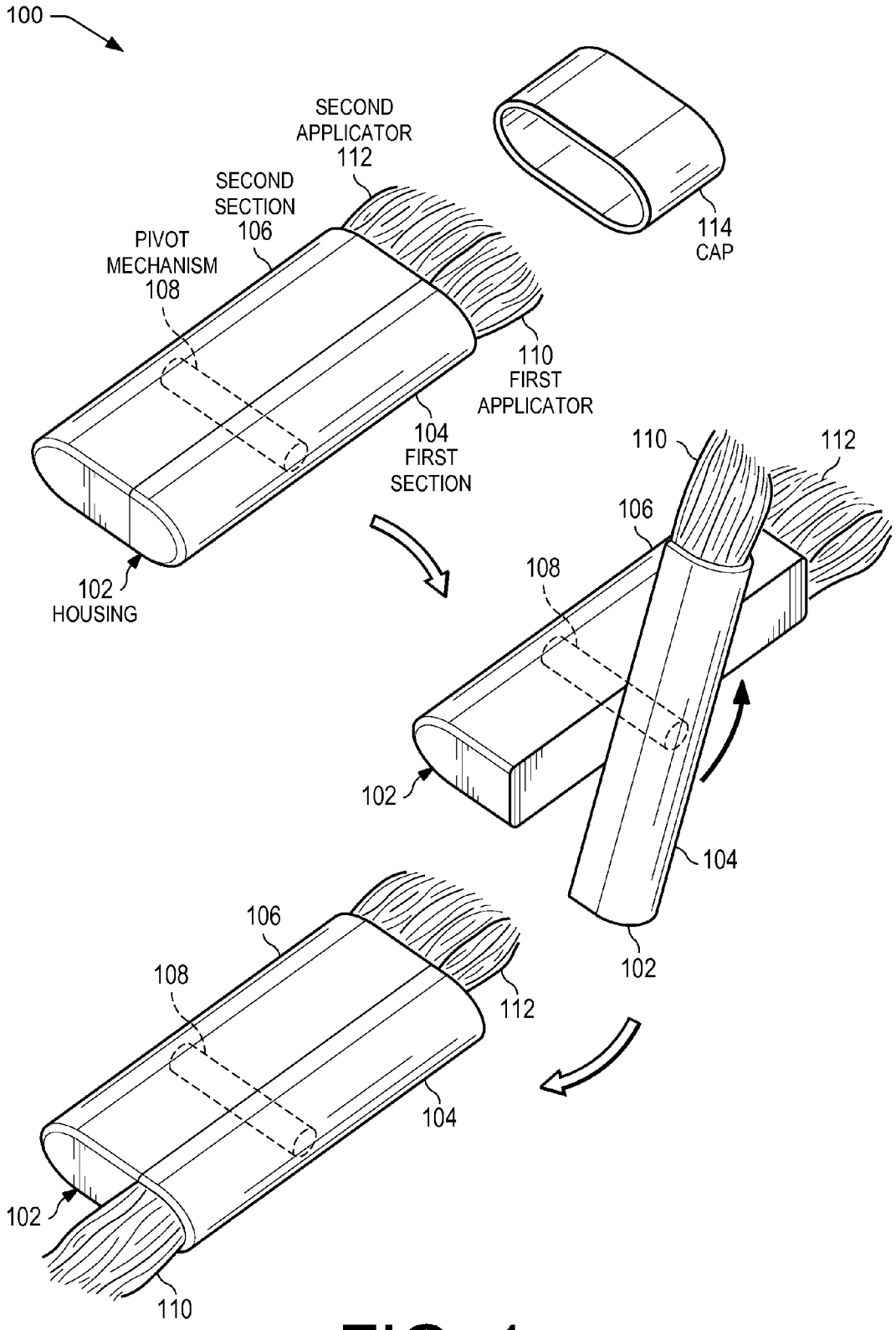
FIG. 1 depicts a first illustrative embodiment of a split-tip applicator.

This application describes a split-tip applicator that has multiple applicators, including at least a first applicator and a second applicator. As used herein, the term "applicator" may be used to refer a brush, a sponge, flocking, a comb, another type of similar or equivalent applicator, or any combination thereof. A sponge may be comprised of an elastic porous mass of interlacing fibers that when wetted is able to absorb liquids. The applicator may be made of natural or synthetic (e.g., rubber, plastic, silicone, and the like) materials.

In some embodiments, the split-tip applicator may include multiple sections and a pivot mechanism that enables a first section to be rotated using the pivot mechanism relative to a second section of the split-tip applicator. For example, in a first position, the first section and the second section may be positioned adjacent to one another to form a continuous applicator perimeter that is longer than each of the individual applicators (e.g., the first applicator and the second applicator). The first position may enable a user to use both applicators as if they were a single large applicator to apply a product to a large area in a relatively short amount of time. For example, a user may use the first position of the split-tip applicator to apply foundation using both the first applicator and the second applicator. In a second position, the first section may be rotated (e.g., approximately 180 degrees) using the pivot mechanism to place the first applicator at an opposite end of the split-tip applicator relative to the second applicator. In some embodiments, the first applicator may have a different size, shape, and/or composition relative to the second applicator. For example, the first applicator and the second applicator may have a split of approximately 10:90, 20:80, 30:70, 40:60, 50:50 etc. To illustrate, for 20:80, the first applicator may comprise approximately 20% of the combined perimeter of the two applicators while the second applicator may comprise approximately 80% of the combined perimeter of the two applicators. When the split-tip applicator is in the second position, the user may use the first applicator to apply a second product and use the second applicator to apply a third product. The first product, the second product, and the third product may be the same product or different products. For example, if the first applicator is larger in size than the second applicator, the user may apply blush to their cheeks using the first applicator and apply eye shadow to their eyes using the second applicator. As another example, a user may apply the same product while using the different configurations of the split-tip applicator to provide different amounts of control (e.g., a larger applicator may be used to broadly apply a product to a surface while a smaller applicator may be used to touch-up the surface using the same product). Thus, a single split-applicator with two different sized applicators may be used to replace three different sized applicators (e.g., a large applicator composed of both the first and second applicator, a medium applicator composed of the first applicator, and a small applicator composed of the second applicator).

In some embodiments, rotating (e.g., approximately 180 degrees) either the first section or the second section about the pivot mechanism may cause both the first applicator and the second applicator to retract into a handle (e.g., housing) of the split-tip applicator. In addition, some embodiments may include a locking mechanism that temporarily locks the pivot mechanism to prevent the sections of the split-tip applicator from inadvertently moving (e.g., rotating). For example, the locking mechanism may include a magnet embedded in one section and a magnetically attractive material embedded in another section of the split-tip applicator. As another example, the locking mechanism may include a protrusion in one section and a corresponding indent in another section of the split-tip applicator. As yet another example, the locking mechanism may include a slide mechanism that can be placed in a locked position or an unlocked position based on a position of the locking mechanism.

In some other embodiments, the split-tip applicator may include multiple slide mechanisms attached via multiple linkages to multiple applicators. The slide mechanisms may enable each of the applicators to be placed in multiple positions. For example, initially, the slide mechanisms may be in a position when all the applicators are retracted into a handle (e.g., housing) of the split-tip applicator. Moving a first slide mechanism in a first direction (e.g., forward) may cause a corresponding first applicator to move in the first direction, resulting in the first applicator moving out of the handle, thereby enabling the first applicator to be used to apply a first product to a surface. Moving a second slide mechanism in the first direction (e.g., forward) may cause a corresponding second applicator to move in the first direction, resulting in the second applicator moving out of the handle of the split-tip applicator, thereby placing the second applicator adjacent to the first applicator to form a continuous applicator perimeter that is longer than each of the individual applicators. When the first applicator is placed adjacent to the second applicator, the applicators may be used together as if they were a single large applicator to apply a second product to a surface. Moving either the first or second slide mechanism in a second direction (e.g., backward) may cause the corresponding applicator to retract into the handle. Moving the first slide mechanism further in the second direction (e.g., backward) may cause the corresponding applicator to move in the second direction, resulting in the corresponding applicator moving out of the handle, such that a third applicator is positioned at an opposite end of the split-tip applicator. Moving the second slide mechanism further in the second direction (e.g., backward) may cause the corresponding applicator to move in the second direction, resulting in the corresponding applicator moving out of the handle, such that a fourth applicator is positioned at an opposite end of the split-tip applicator. In some embodiments, one or more of the first, second, third, and fourth applicators may have a different size, shape, and/or composition relative to the other applicators. For example, sliding both slide mechanisms forward may result in two brushes coming out of the front of the handle while sliding both slide mechanisms backward may result in two sponge applicators coming out of the back of the handle. Thus, a single split-applicator with two different sized applicators may be used to replace up to six different sized applicators (e.g., a first-sized applicator composed of both the first and second applicator, a second-sized applicator composed of both the third and fourth applicator, a third-sized applicator composed of the third applicator, a fourth-sized applicator composed of the fourth applicator, a fifth-sized applicator composed of the first applicator, and a sixth-sized applicator composed of the second applicator).

The slide-mechanism described herein may be actuated by any suitable actuation mechanism, such as, for example, a gripable portion (e.g., a rectangular bar, a disk-shaped knob or nodule, or the like) slideably disposed on an exterior surface of the split-tip applicator, a magnetic knob slideably disposed on the exterior surface of the split-tip applicator, a dial disposed on the exterior surface of the split-tip applicator, a push-button disposed on an exterior surface of the split-tip applicator, or the like. In embodiments that employ a brush applicator, various embodiments of the brush are also contemplated. For example, the brush may comprise a group of hairs that are natural (e.g., animal), synthetic (e.g., plastic or rubber), or the like. Further, the brush may comprise a single unit of bristles over-molded to a base of the brush and be formed of plastic. For example, the brush may comprise a single unit of shaft-shaped bristles over-molded to the base of the brush, a single unit of blade-shaped bristles over-molded to the base of the brush, or the like.

Split-Tip Applicator with Pivot Mechanism

FIG. 1 depicts a first illustrative embodiment of a split-tip applicator 100. The split-tip applicator 100 includes a handle 102 (e.g., a housing), a first section 104, a second section 106, and a pivot mechanism 108. The handle 102 may be formed using one or more of metal, plastic (e.g., polypropylene (PP), acrylonitrile butadiene styrene (ABS), or Polyoxymethylene (POM)), glass, wood, or other suitable material.

A first applicator 110 may be affixed to the first section 104 and a second applicator 112 may be affixed to the second section 106. Each of the first applicator 110 or the second applicator 112 may include one or more of a brush, a sponge, flocking, a comb, or another type of applicator. In some cases, the first applicator 110 may be a same size and/or shape as compared to the second applicator 112. In other cases, the first applicator 110 may be a different size and/or shape as compared to the second applicator 112. For example, as illustrated in FIG. 1, the first applicator 110 may be smaller than the second applicator 112.

In some embodiments, a cap 114 may be temporarily mated (e.g., attached) to the housing 102 to protect the applicators 110 and 112 when the applicators 110 and 112 are not in use, to prevent debris from contacting the applicators 110 and 112, or to prevent products on the applicators 110 and 112 from leaking on to surrounding articles. For example, the cap 114 may be placed over the applicators 110 and 112 to temporarily mate the cap 114 to the handle 102. The cap 114 may temporarily mate with the handle 102 to prevent the cap from inadvertently being removed. For example, the cap 114 may snap in place with the handle 102. As another example, the cap 114 and the handle 102 may have threads that enable the cap 114 to be screwed on to and unscrewed from the handle 102. Of course, other types of mechanisms may be used to temporarily mate the cap 114 to the handle 102. In some embodiments, the cap 114 may temporarily mate with one end of the handle 102 while a second cap may mate with an opposite end of the handle 102. When attached to the handle 102, the cap 114 may prevent the first and second applicators 110 and 112 from rotating relative to each other.

The pivot mechanism 108 may attach the first section 104 to the second section 106 while enabling the first section 104 to rotate relative to the second section 106. For example, the user may rotate the first section 104 relative to the second section 106 between (1) a first position in which the first applicator 110 is aligned with (e.g., adjacent to) the second applicator 112 and (2) a second position in which the first applicator 110 is at an opposite end of the handle 102 relative to the second applicator 112.

In the first position, the first applicator 110 may be placed adjacent to the second applicator 112 to define a continuous applicator perimeter that is longer than a perimeter of either the first applicator 110 or the second applicator 112. For example, placing the first applicator 110 adjacent to the second applicator 112 may enable the user to use the applicators 110 and 112 as if they were a large brush (e.g., with a perimeter that is the combined perimeter of the applicators 110 and 112). The first position may enable the user to apply a product (e.g., foundation) to a large area of a surface (e.g., the user's face) due to the relatively large perimeter formed by the adjacent applicators 110 and 112.

In the second position, the first applicator 110 may be placed at an opposite end of the split-tip applicator 100 relative to the second applicator 112. For example, one of the applicators 110 or 112 may be rotated approximately 180 degrees to place the first applicator 110 at one end of the split-tip applicator 100 while the second applicator 112 is at another (e.g., opposite) end of the split-tip applicator 100. The second position may provide two separate applicators located at opposite ends of the split-tip applicator 100 to enable the user to apply two different products. For example, the user may use the first applicator 110 to apply a second product (e.g., blush) while using the second applicator 112 to apply a third product (e.g., eye shadow). As another example, if the first applicator 110 is larger than the second applicator 112, the first applicator 110 may be used to apply the second product to a relatively large area while the second applicator 112 may be used to apply the second product with finer control to a relatively small area. In this example, the second applicator 112 may be used to provide finer control compared to the first applicator 110, such as to touch up smaller portions of the surface.

In some implementations, the applicators 110 or 112 may have a same size, shape, and/or composition (e.g., a brush having multiple bristles, a sponge, a comb, flocking, and the like) while in other implementations, the applicators 110 or 112 may have a different size, shape, and/or composition. For example, the first applicator 110 may have a size, shape, and/or composition similar to a first type of specialized applicator (e.g., blush brush) while the second applicator 112 may have a size, shape, and/or composition similar to a second type of specialized applicator (e.g., eye shadow). To illustrate, the first applicator 110 may be smaller in size relative to the second applicator 112 (or vice-versa). As another example, when both the applicators 110 and 112 include bristles, the applicators 110 and 112 may have a same or a different number of bristles, sizes of bristles, shapes of bristles shapes of holders for the bristles, and the like.

Thus, the pivot mechanism 108 may enable the user to configure the split-tip applicator in two different positions (e.g., the first position and the second position). If the first applicator 110 has a different size relative to the second applicator 112, the two different positions may enable the user to derive three different sized applicators from the split-tip applicator 100, such as a large applicator (e.g., when the applicators 110 and 112 are adjacent to each other), a medium applicator (e.g., the second applicator 112), and a small applicator (e.g., the first applicator 110). For example, in the first position, in which the first applicator 110 is adjacent to the second applicator 112, the split-tip applicator 100 may be used as a large sized applicator due to the combined perimeters of the applicators 110 and 112. In the second position, in which the applicators 110 and 112 are at opposite ends of the split-tip applicator 100, one of the applicators 110 and 112 may be used as a medium sized applicator while the other of the applicators 110 and 112 may be used as a small sized applicator. The applicators 110 and 112 may have different shapes. For example, each of the applicators 110 or 112 may include a fan-shape, a rectangular-shape, a semi-circular shape, a wedge-shape, another type of geometric shape, or any combination thereof. If either or both of the applicators 110 or 112 include brushes, in some cases at least one of the brushes may include a few individual larger bristles than the other bristles in the brush.

The split-tip applicator 100 may be used to apply different products to one or more surfaces. For example, the split-tip applicator 100 may be used to apply different cosmetic products, such as blush, foundation, mascara, eye shadow, etc., to a surface, such as a skin of a human being. The split-tip applicator 100 may, in some cases, include a locking mechanism, as described in FIG. 2. Additionally, in some cases, the split-tip applicator 100 may be placed in a full-retracted position, in which the applicators 110 and 112 are fully retracted into the handle 102, as described in FIG. 2.

Figure 2:
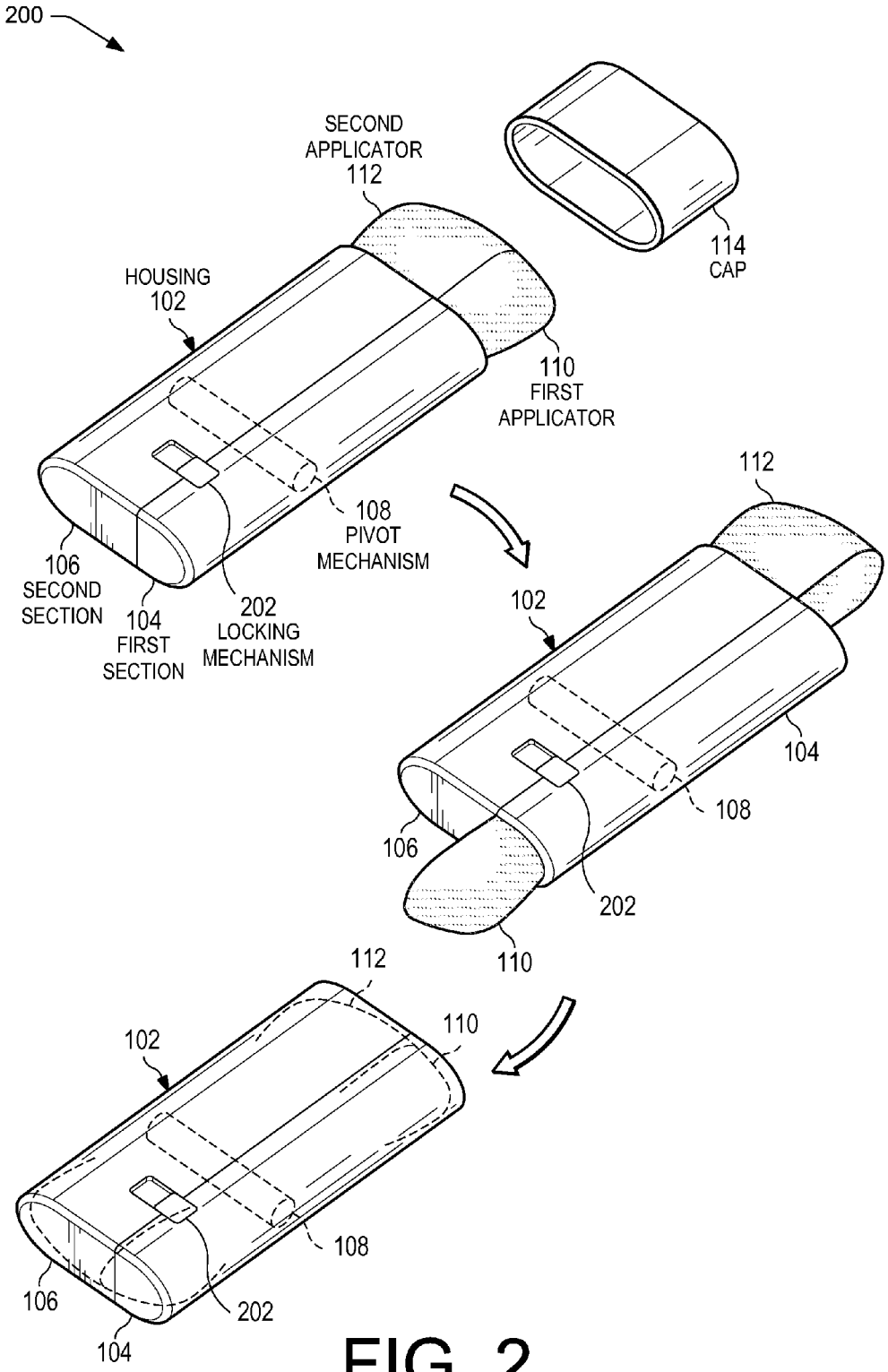
FIG. 2 depicts a second illustrative embodiment of a split-tip applicator.

FIG. 2 depicts a second illustrative embodiment of a split-tip applicator 200. The split-tip applicator 200 illustrates how a locking mechanism 202 may be used to prevent the first section 104 from inadvertently rotating (e.g., pivoting) relative to the second section 106. In addition, the split-tip applicator 200 illustrates how rotating one of the sections 104 or 106 may place the applicators 110 and 112 in a retracted position in the handle 102.

The retracted position may be achieved through various combinations of movements (e.g., rotations) of the first section 104 or the second section 106 in different directions (e.g., clockwise or counter-clockwise). For example, initially, the split-tip applicator 200 may be in the first position, in which the first applicator 110 is adjacent to the second applicator 112. Rotating the first section 104 approximately 180 degrees in a first direction, relative to the second section 106, may place the split-tip applicator 200 in the second position, in which the applicators 110 and 112 are at opposite ends of the split-tip applicator 200. Rotating the first section 104 an additional approximately 180 degrees in the first direction, relative to the second section 106, may place the split-tip applicator 200 in the retracted position, in which the applicators 110 and 112 are retracted into the handle 102. Rotating the second section 106 an additional approximately 180 degrees in the first direction, relative to the first section 104, may place the split-tip applicator 200 in the first position.

As another example, initially, the split-tip applicator 200 may be in the first position. Rotating the first section 104 approximately 180 degrees in a first direction (e.g., clockwise) relative to the second section 106 may place the split-tip applicator 200 in the second position. Rotating the first section 104 approximately 180 degrees in an opposite direction (e.g., counter-clockwise) relative to the second section 106 may place the split-tip applicator 200 in the retracted position. Rotating the first section 104 an additional approximately 180 degrees in the first direction relative to the second section 106 may place the split-tip applicator 200 in the first position. Of course, other combinations in which the sections 104 or 106 are rotated relative to each other in different directions (e.g., clockwise or counter-clockwise) to place the split-tip applicator in the first position, the second position, or the retracted position are possible. The mechanism to retract the applicators 110 and 112 may be accomplished using various mechanisms, such as one or more gears and/or linkages (e.g., rack and pinion etc.).

The locking mechanism 202 may prevent the first section 104 from inadvertently moving relative to the second section 106 or prevent the second section 106 from inadvertently moving relative to the first section 104. The locking mechanism 202 may provide at least two states for the split-tip applicator 200, e.g., a locked state and an unlocked state. For example, in the locked state, the user may rotate either of the sections 104 or 106 in response to exerting a small amount of force, e.g., an amount of force sufficient to identify a deliberate action. In the unlocked state, the user may rotate either of the sections 104 or 106 using very little force.

The locking mechanism 202 may be implemented using one of several different techniques. For example, the locking mechanism 202 may use a mechanical mechanism, such as a slider, that has a locked position and an unlocked position. In the locked position, the locking mechanism 202 may prevent the section 104 from rotating relative to the section 106 and the section 106 from rotating relative to the section 104. In the unlocked position, the section 104 may rotate relative to the section 106 or the section 106 may rotate relative to the section 104.

As another example, the locking mechanism 202 may use a magnet (or other type of magnetized material) along with a magnetically attractive material. For example, the magnet may be embedded into one of the sections 104 or 106 and the magnetically attractive material (e.g., a metal that is attracted to a magnet or a second magnet) may be embedded into the other of the sections 104 or 106. The magnet and the magnetically attractive material may be embedded in particular positions in the sections 104 or 106 such that the magnet and the magnetically attractive material have a close proximity to each other in the first position (e.g., where the applicators 110 and 112 are adjacent to each other), the second position (e.g., whether the applicators 110 and 112 are at opposite ends of the split-tip applicator 200), and in the retracted position (e.g., where the applicators 110 and 112 are retracted into the handle 102).

As yet another example, the locking mechanism 202 may use a protrusion in an inner surface of one of the sections 104 or 106 along with a corresponding indentation in an inner surface of the other of the sections 104 or 106. The protrusion and the indentation may be positioned in the sections 104 or 106 such that the protrusion in one section fits into the indentation of the other section in the first position, the second position, and the retracted position. Of course, the locking mechanism 202 may be implemented using other techniques in addition to those described herein.

Thus, in this example, moving the sections 104 and 106 in different directions relative to one another may place the split-tip applicator in one of three positions. In the first position, the first applicator 110 may be placed approximately adjacent to the second applicator 112. In the second position, the applicator 110 may be located at an opposite end of the split-tip applicator 200 relative to the applicator 112. In the third position, both the applicators 110 and 112 may be retracted into the handle (e.g., housing). The cap 114 may be mated to the handle 102 in one or more of the first position, the second position, or the third position.

While FIGS. 1 and 2 illustrate a split-tip applicator with two sections and two corresponding applicators, other embodiments of the split-tip applicator may include more than two sections and more than two corresponding applicators. For example, split-tip applicators with three or more sections may be joined using the pivot mechanism 108, with each section capable of being rotated relative to the other sections.

Split-Tip Applicator with Slider Mechanisms

Figure 3:
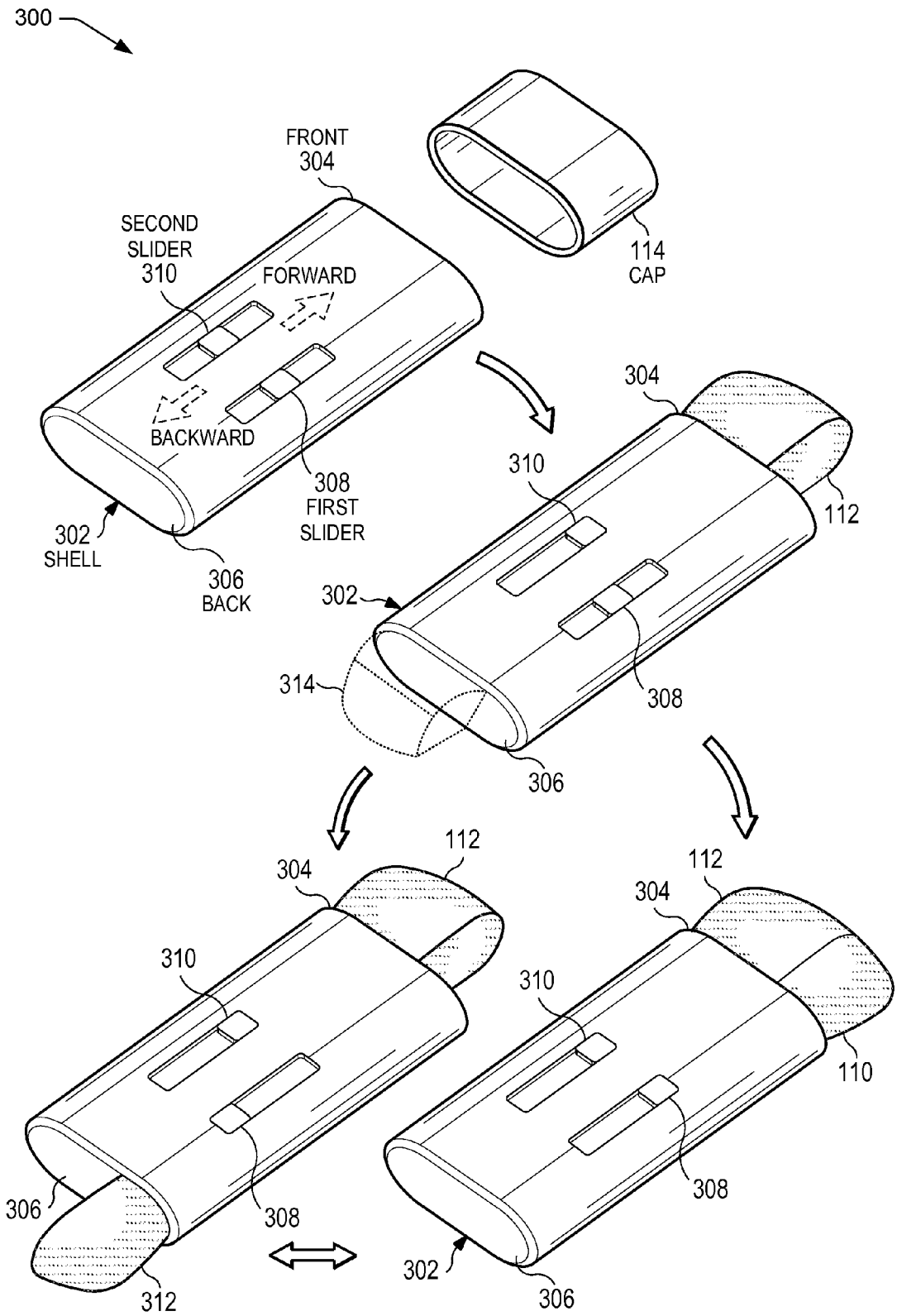
FIG. 3 depicts a third illustrative embodiment of a split-tip applicator.

FIG. 3 depicts a third illustrative embodiment of a split-tip applicator 300. The split-tip applicator 300 illustrates using slider mechanisms (e.g., rather than rotating sections) to place the applicators in various positions. For example, the positions of the split-tip applicator 300, based on the positions of two slider mechanisms, may include one or more of (retracted, retracted), (forward, retracted), (backward, retracted), (retracted, forward), (retracted, backward), (forward, backward), (backward, forward), (forward, forward), and (backward, backward).

The split-tip applicator 300 may include a shell 302 with two ends, referred to in FIG. 3 as a front 304 and a back 306 of the shell 302. A first slider (e.g., slider mechanism) 308 and a second slider 310 may be disposed on the shell 302. Sliding one or both of the sliders 308 and 310 towards the front 304 may be referred to as sliding forward. Sliding one or both of the sliders 308 and 310 towards the back 306 may be referred to as sliding backward.

When the split-tip applicator 300 is in the (retracted, retracted) position, each of the sliders 308 and 310 may be in a retracted (e.g., middle) position in which both the applicators 110 and 112 are retracted into the shell 302. From the retracted position, the split-tip applicator 300 may be placed in various positions.

From the retracted position (e.g., in which both applicators 110 and 112 are retracted), sliding the second slider 310 forward may cause the second applicator 112 to move forward (e.g., towards the front 304) and out of the shell 302, placing the split-tip applicator 300 in the (retracted, forward) position. The (retracted, forward) position may enable the second applicator 112 to be used to apply a product to a surface. From the (retracted, forward) position, sliding the first slider 308 forward may cause the first applicator 110 to move forward (e.g., towards the front 304) and out of the shell 302, thereby placing the first applicator 110 adjacent to the second applicator 112, e.g., placing the split-tip applicator 300 in the (forward, forward) position. The applicators 110 and 112 may together define a continuous perimeter that is longer than the individual applicators 110 or 112.

From the retracted position, sliding the first slider 308 backward may cause a third applicator 312 to move backward (e.g., towards the back 306) and out of the shell 302, thereby placing the split-tip applicator 300 in the (backward, retracted) position. The (backward, retracted) position may enable the third applicator 312 to be used to apply a product to a surface. From the (backward, retracted) position, sliding the second slider 310 backward may cause a fourth applicator 314 to move backward (e.g., towards the back 306) and out of the shell 302, thereby placing the fourth applicator 314 adjacent to the third applicator 312 and placing the split-tip applicator 300 in the (backward, backward) position. The applicators 312 and 314 may together define a continuous perimeter that is longer than the individual applicators 312 or 314.

From the retracted position (e.g., in which both applicators 110 and 112 are retracted), sliding the first slider 308 forward may cause the first applicator 110 to move forward, placing the split-tip applicator 300 in the (forward, retracted) position. From the (forward, retracted) position, sliding the second slider 310 backward may cause the fourth applicator 314 to move backward, thereby placing the fourth applicator 314 at an opposite end of the shell 302 relative to the first applicator 110, e.g., placing the split-tip applicator 300 in the (forward, backward) position. In the (forward, backward) position, the first applicator 110 may be used to apply a first product while the fourth applicator 314 may be used to apply a second product.

From the retracted position (e.g., in which both applicators 110 and 112 are retracted), sliding the first slider 308 backward may cause the third applicator 312 to move backward, and sliding the second slider 310 forward may cause the second applicator 112 to move forward, thereby placing the second applicator 112 at an opposite end of the shell 302 relative to the third applicator 312, e.g., placing the split-tip applicator 300 in the (backward, forward) position. In the (backward, forward) position, the second applicator 112 may be used to apply a first product while the third applicator 312 may be used to apply a second product.

From the retracted position (e.g., in which both applicators 110 and 112 are retracted), sliding the second slider 310 backward may cause the fourth applicator 314 to move backward (e.g., towards the back 306) and out of the shell 302, placing the split-tip applicator 300 in the (retracted, backward) position. The (retracted, backward) position may enable the fourth applicator 314 to be used to apply a product to a surface.

The sliders 308 and 310 may be implemented in several different ways. For example, multiple actuators may be disposed on an exterior surface of the shell 302 for selectively sliding one or more of the sliders 308 or 310 housed in the shell 302 to move one or more of the applicators 110, 112, 312, 314 in and out of the shell 302. In some embodiments, multiple linkages may be received by multiple slots disposed in the exterior surface of the shell 302. Each of the multiple linkages may be fixed to a bottom of a corresponding actuator and to a top of the corresponding slide-mechanism (e.g., the sliders 308 and 310) of the multiple slide-mechanisms.

In some cases, the sliders 308 and 310 may also incorporate a type of locking mechanism to temporarily lock one or more of the applicators 110, 112, 312, 314 in the forward, retracted, or backward position. The locking mechanism may prevent the sliders (and corresponding applicators) from inadvertently moving from a current position of the sliders.

Thus, the split-tip applicator 300 may use slider mechanisms, such as the sliders 308 and 310, to enable each of the multiple applicators, such as the applicators 110 and 112, to be extended forward and out the front of the shell 302 or extended backward and out the rear of the shell 302. Using the sliders 308 and 310, the user may place the applicators 110 and 112 in various positions, including the first position (e.g., both applicators 110 and 112 extended out of the front 304 or the back 306 of the shell 302), the second position (e.g., one of the applicators 110 or 112 extended out of an opposite end relative to the other applicator), the retracted position (e.g., both applicators 110 and 112 retracted), and the single applicator position (e.g., one of the applicators 110 or 112 extended either forward or backward while the other applicator is retracted into the shell 302). The various positions may enable the split-tip applicator 300 to replace up to six applicators, such as a first-sized applicator (e.g., when sliders 308 and 310 have been slid forward), a second-sized applicator (e.g., when sliders 308 and 310 have been slid backward), a third-sized applicator (e.g., when slider 308 has been slid forward), a fourth-sized applicator (e.g., when slider 310 has been slid forward), a fifth-sized applicator (e.g., when slider 308 has been slid backward), a sixth-sized applicator (e.g., when slider 310 has been slid backward). This may enable a user to apply up to six products to one or more surfaces using just the split-tip applicator 300.

While FIG. 3 illustrates a split-tip applicator with two slide mechanisms and four corresponding applicators, other embodiments of the split-tip applicator may include more than two slide mechanisms and more than four corresponding applicators. For example, split-tip applicators with three or more slide mechanisms may have six or more corresponding applicators, with each slide mechanism capable of moving a corresponding applicator to an extended forward, a retracted (e.g., middle) position, or an extended backward position.

Exemplary Methods of Using a Split-Tip Applicator

Figure 4:
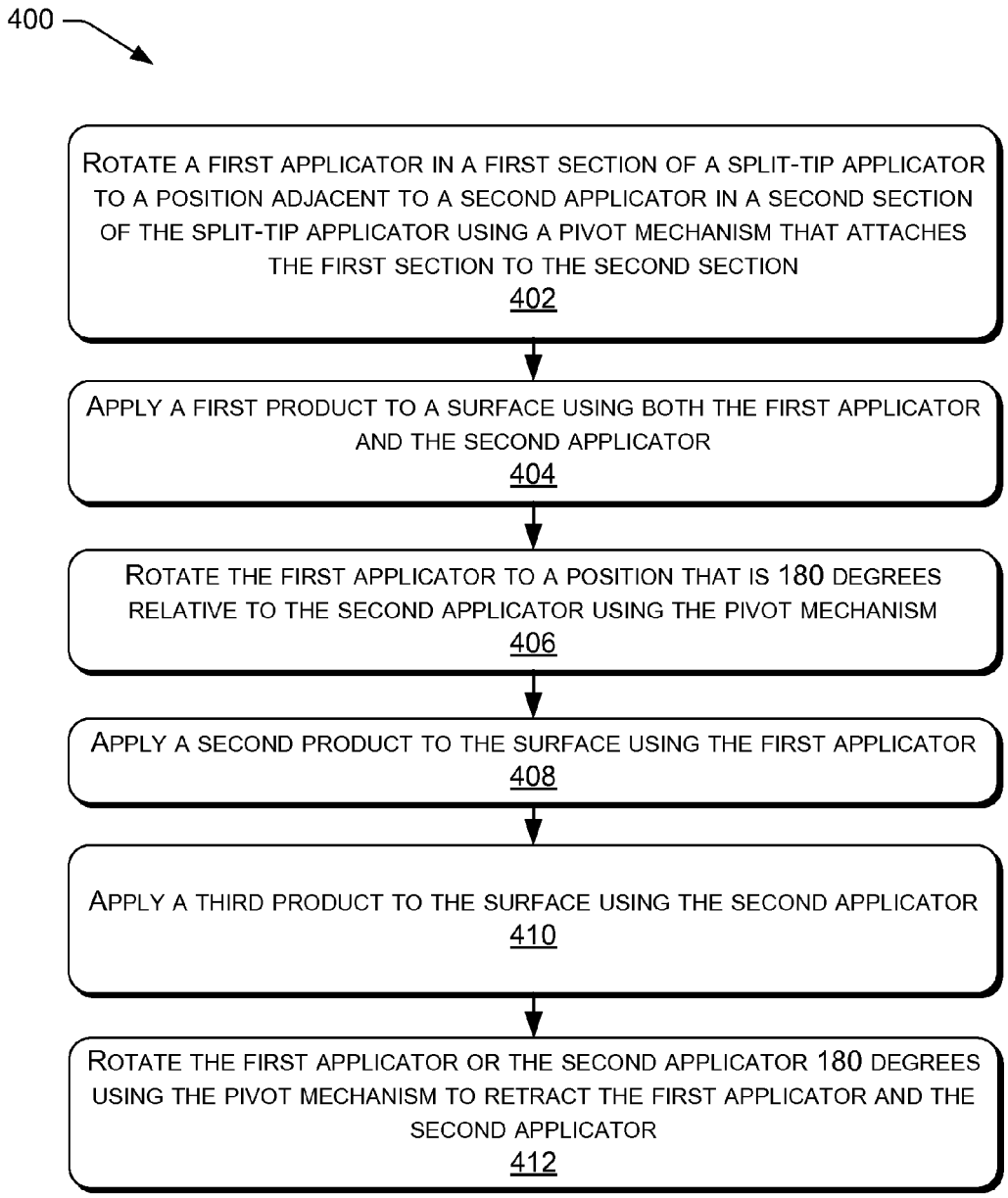
FIG. 4 is a flow diagram of an illustrative process for using the split-tip applicator of FIG. 1 or FIG. 2.
Figure 5:
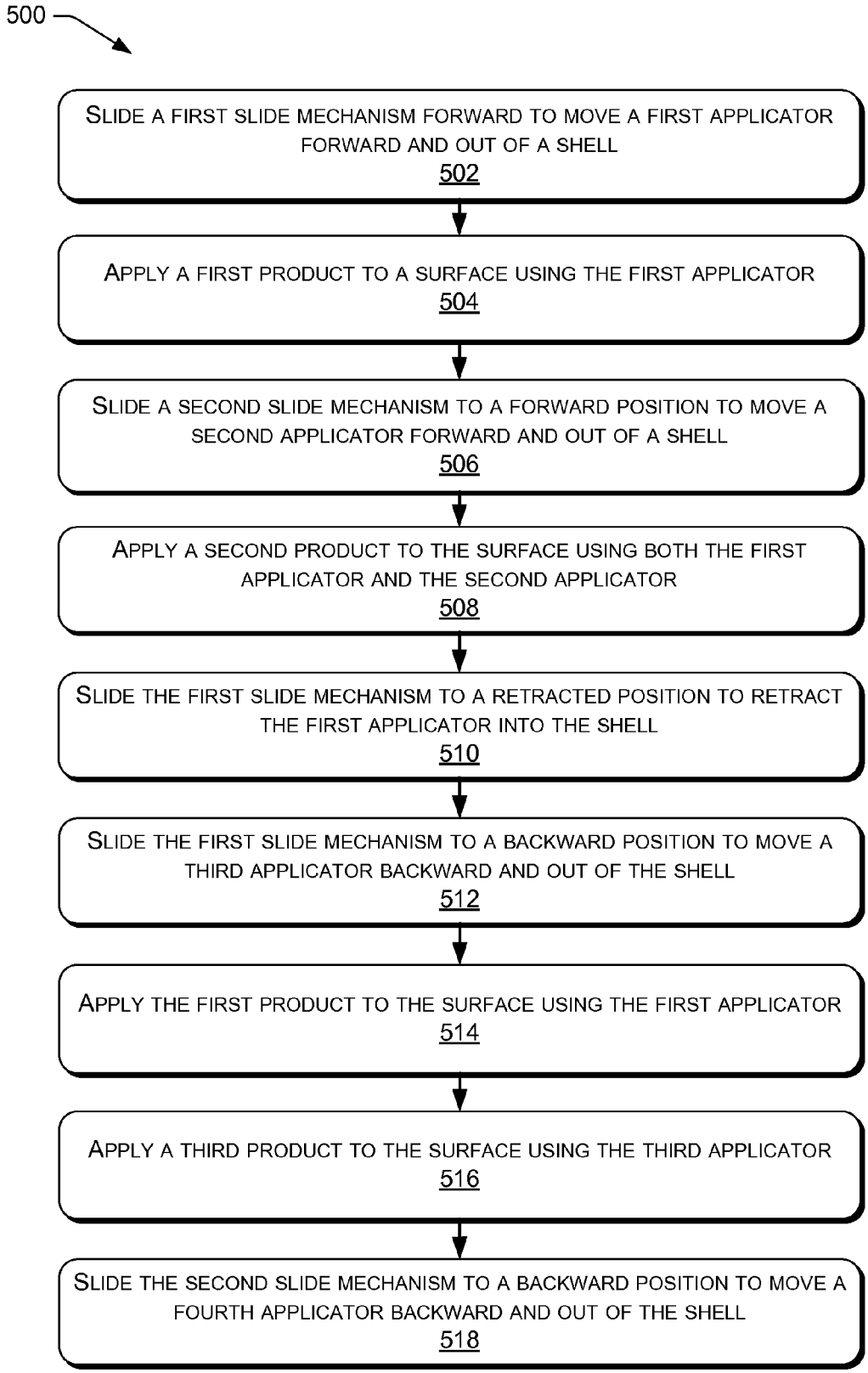
FIG. 5 is a flow diagram of an illustrative process for using the split-tip applicator of FIG. 3.

FIG. 4 and FIG. 5 are flow diagrams of example processes 400 and 500 which may, but need not necessarily, be performed using the split-tip applicator 100 of FIG. 1, the split-tip applicator 200 of FIG. 2, or the split-tip applicator 300 of FIG. 3. For convenience, the process 400 is described with reference to the split-tip applicator 100 of FIG. 1 or the split-tip applicator 200 of FIG. 2, and the process 500 is described with reference to the split-tip applicator 300 of FIG. 3. However, the processes 400 and 500 are not limited to just the embodiments of FIGS. 1-3. For instance, a user may perform operations from the processes 400 or 500 to apply one or more products to one or more surfaces, to remove one or more products from one or more surfaces, and other operations in which applicators may be used. In some instances, the user may perform the processes 400 and 500 in a manufacturing environment, in a commercial environment (e.g., beauty salon), or in a place of residence.

FIG. 4 is a flow diagram of an illustrative process 400 for using the split-tip applicator of FIG. 1 or FIG. 2. The process 400 may be performed using the split-tip applicators 100 or 200.

At 402, a first applicator in a first section of a split-tip applicator may be rotated to a position adjacent to a second applicator of the split-tip applicator using a pivot mechanism that attaches the first section to the second section. For example, in FIG. 1 or FIG. 2, the first applicator 110 in the first section 104 may be rotated to a position adjacent to the second applicator 112 of the split-tip applicator 100 or 200 using the pivot mechanism 108 that attaches the first section 104 to the second section 106. In some cases, the locking mechanism 202 may be used to temporarily lock the split-tip applicator in a position where the applicators 110 and 112 are adjacent to each other to prevent either of the sections 104 or 106 from rotating relative to each other.

At 404, a first product may be applied to a surface using both the first applicator and the second applicator. For example, in FIG. 1 or FIG. 2, placing the first applicator 110 adjacent to the second applicator 112 may define a continuous applicator perimeter that is longer than the individual perimeters of the applicators 110 or 112, enabling the applicators 110 and 112 to be used to apply a product to a large area in a relatively short period of time.

At 406, the first applicator may be rotated to a position that is approximately 180 degrees relative to the second applicator using the pivot mechanism. For example, in FIG. 1 or FIG. 2, the first section 104 may be rotated approximately 180 degrees relative to the second section 106 using the pivot mechanism 108 to place the first applicator 110 at an opposite end of the handle 102 relative to the second applicator 112. If the split-tip applicator was in the locked position, the locking mechanism 202 may be placed in an unlocked position (e.g., by sliding a mechanical locking mechanism or by exerting an amount of force to overcome a magnetic attraction or by exerting an amount of force that pushes a protrusion out of an indent) before the first section 104 is rotated. After the first section 104 has been rotated approximately 180 degrees, the locking mechanism 202 may be placed in the locked position to prevent the sections 104 and 106 from inadvertently rotating.

At 408, a second product may be applied to the surface using the first applicator. At 410, a third product may be applied to the surface using the second applicator. For example, in FIG. 1 or FIG. 2, when the first applicator 110 is at an opposite end of the handle 102 relative to the second applicator 112, the first applicator 110 may be used to apply a second product to a surface and the second applicator 112 may be used to apply a third product to a surface.

At 412, rotating the first applicator or the second applicator 180 degrees using the pivot mechanism may retract the first applicator and the second applicator. For example, in FIG. 2, based on a position (e.g., the first position in which the applicators are adjacent to each other or the second position in which the applicators are at opposite ends) in which the split-tip applicator 200 has been placed, rotating either the first applicator 110 or the second applicator 112 180 degrees in a particular direction (e.g., clockwise or counter-clockwise) may cause the applicators 110 and 112 to retract into the handle 102. Before rotating one of the applicators 110 or 112, the locking mechanism 202 may be placed in the unlocked position to enable the sections 104 or 106 to be easily rotated relative to each other.

Thus, a split-tip applicator may have two sections that may be rotated relative to one another about a pivot mechanism, enabling the split-tip applicator to be placed in various positions. For example, in a first position, two applicators may be placed adjacent to each other to provide a continuous applicator perimeter that is longer than the individual perimeters of each of the applicators. In a second position, a first applicator may be placed at an opposite end of the split-tip applicator relative to a second applicator. When the two applicators differ in one or more of a size, shape, or composition, the first applicator may be used to apply a first product while the second applicator may be used to apply a second product. In a retracted position, both applicators may be retracted into the housing of the split-tip applicator. In some cases, a locking mechanism may be used to lock the split-tip applicator in the first position, the second position, or the retracted position to prevent the sections (and the corresponding applicators) from rotating. The locking mechanism may be placed in an unlocked position prior to rotating the sections (and the corresponding applicators).

FIG. 5 is a flow diagram of an illustrative process 500 for using the split-tip applicator of FIG. 3. The process 500 may be performed using the split-tip applicators 100 or 200.

At 502, a first slide mechanism may be slid forward to move a first applicator forward and out of a shell. At 504, a first product may be applied to a surface using the first applicator. For example, in FIG. 3, when the both of the sliders 308 and 310 are in the retracted position, sliding the first slider 308 forward may move the first applicator 110 forward and out of the front 304 of the shell 302.

At 506, a second slide mechanism may be slid forward to move a second applicator forward and out of a shell. For example, in FIG. 3, sliding the second slider 310 forward may move the second applicator 112 forward and out of the front 304 of the shell 302, placing the second applicator 112 adjacent to the first applicator 110.

At 508, a second product may be applied to the surface using both the first applicator and the second applicator. For example, in FIG. 3, when the second applicator 112 adjacent to the first applicator 110, both the applicators 110 and 112 may be used as one large applicator with a perimeter that is the sum of the individual perimeters of the applicators 110 and 112.

At 510, the first slide mechanism may be slid to a retracted position to retract the first applicator into the shell. For example, in FIG. 3, sliding the first slider 308 backward may retract the first applicator 110 into the shell 302.

At 512, the first slide mechanism may be slid to a backward position to move a third applicator backward and out of the shell. For example, in FIG. 3, sliding the first slider 308 backward may move a third applicator 312 backward and out of the back 306 of the shell 302, placing the third applicator 312 at an opposite end of the split-tip applicator 300 relative to the first applicator 110.

At 514, a first product may be applied to the surface using the first applicator.

At 516, a third product may be applied to the surface using the third applicator. For example, in FIG. 3, when the third applicator 112 is placed at an opposite end of the split-tip applicator 300 relative to the first applicator 110, each of the applicators 110 and 312 may be used to apply a different product to a surface. When the third applicator 312 is placed at an opposite end of the split-tip applicator 300 relative to the first applicator 110, the applicators 110 and 312 may provide different levels of control when applying the same product to a surface due to differences between the applicators 110 and 312 in terms of size, shape, and/or composition. To illustrate, if the third applicator 312 is larger in size compared to the first applicator 110, the third applicator 312 may be used to broadly apply a product to a surface while the first applicator 110 may be used for "touch-up" due to the greater control and accuracy provided by the smaller sized applicator.

In some embodiments, the second slide mechanism may be slid to a backward position to move a fourth applicator backward and out of the shell. For example, in FIG. 3, sliding the second slider 312 backward may move a fourth applicator backward and out of the back 306 of the shell 302, placing the fourth applicator 312 adjacent to the third applicator 312 at the back 306 of the shell 302.

Figure 6:
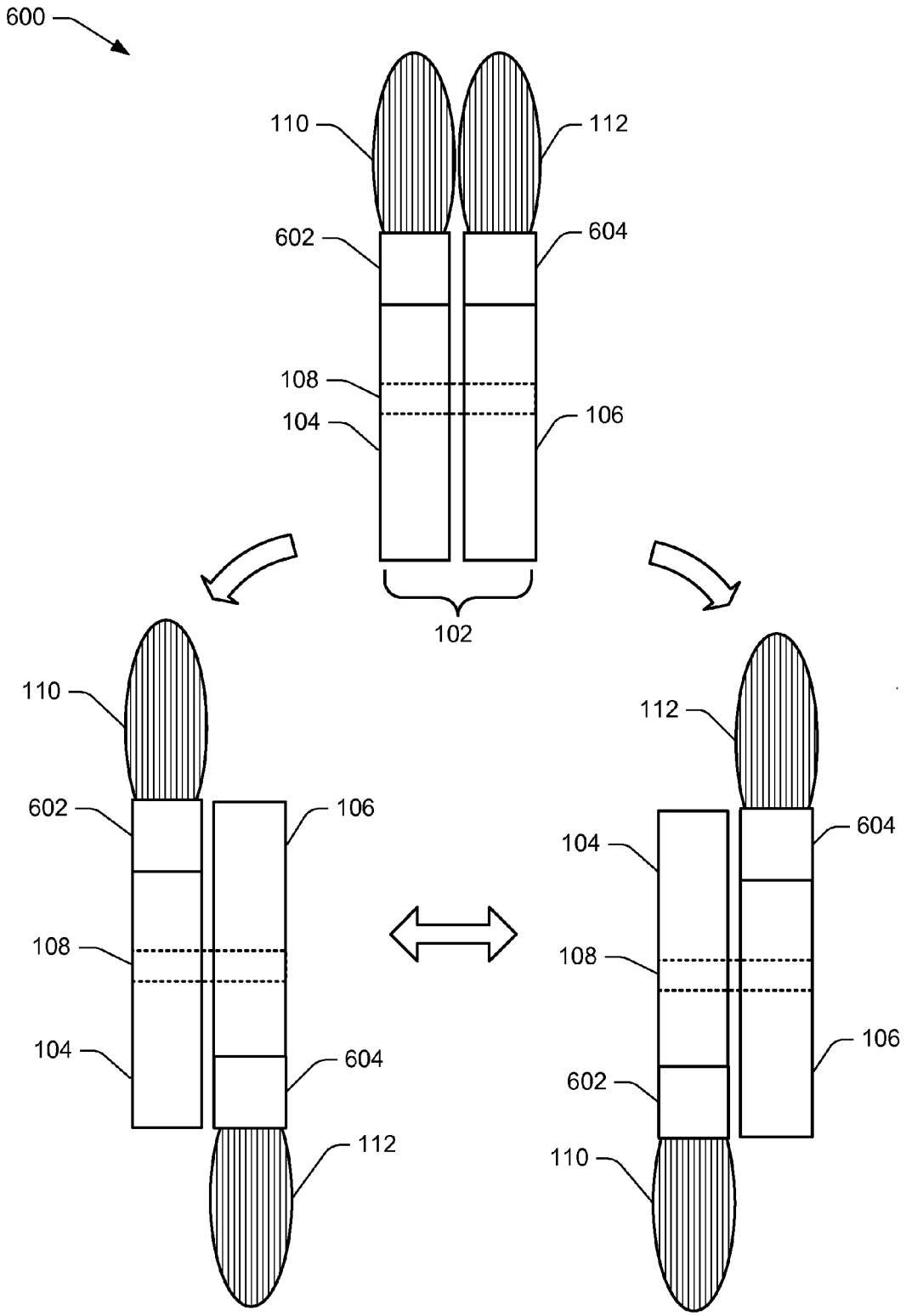
FIG. 6 depicts a fourth illustrative embodiment of a split-tip applicator.

FIG. 6 depicts a fourth illustrative embodiment of a split-tip applicator 600. The split-tip applicator 600 includes the handle 102, the first section 104, the second section 106, and the pivot mechanism 108. The first applicator 110 may be affixed to the first section 104 using a first ferrule 602. The second applicator 112 may be affixed to the second section 106 using a second ferrule 604. Each of the first applicator 110 or the second applicator 112 may include one or more of a brush, a sponge, flocking, a comb, or another type of applicator. In some cases, the first applicator 110 may be a same size and/or shape as compared to the second applicator 112. In other cases, the first applicator 110 may be a different size and/or shape as compared to the second applicator 112. For example, as illustrated in FIG. 6, the first applicator 110 and the second applicator 112 may have approximately the same size.

The pivot mechanism 108 may attach the first section 104 to the second section 106 while enabling the first section 104 to rotate relative to the second section 106. For example, the user may rotate the first section 104 relative to the second section 106 between (1) a first position in which the first applicator 110 is aligned with (e.g., adjacent to) the second applicator 112 and (2) a second position in which the first applicator 110 is at an opposite end of the handle 102 relative to the second applicator 112.

The pivot mechanism 108 may be used to place the first applicator adjacent to the second applicator 112 to define a continuous applicator perimeter that is longer than a perimeter of either the first applicator 110 or the second applicator 112. For example, placing the first applicator 110 adjacent to the second applicator 112 may enable the user to use the applicators 110 and 112 as if they were a large brush (e.g., with a perimeter that is the combined perimeter of the applicators 110 and 112). The first position may enable the user to apply a product (e.g., foundation) to a large area of a surface (e.g., the user's face) due to the relatively large perimeter formed by the adjacent applicators 110 and 112.

The first applicator 110 may be placed at an opposite end of the split-tip applicator 600 relative to the second applicator 112. For example, one of the applicators 110 or 112 may be rotated approximately 180 degrees to place the first applicator 110 at one end of the split-tip applicator 600 while the second applicator 112 is at another (e.g., opposite) end of the split-tip applicator 600. The second position may provide two separate applicators located at opposite ends of the split-tip applicator 600 to enable the user to apply two different products. For example, the user may use the first applicator 110 to apply a second product (e.g., blush) while using the second applicator 112 to apply a third product (e.g., eye shadow). As another example, if the first applicator 110 is larger than the second applicator 112, the first applicator 110 may be used to apply the second product to a relatively large area while the second applicator 112 may be used to apply the second product with finer control to a relatively small area. In this example, the second applicator 112 may be used to provide finer control compared to the first applicator 110, such as to touch up smaller portions of the surface.

In some implementations, the applicators 110 or 112 may have a same size, shape, and/or composition (e.g., a brush having multiple bristles, a sponge, a comb, flocking, and the like) while in other implementations, the applicators 110 or 112 may have a different size, shape, and/or composition. For example, the first applicator 110 may have a size, shape, and/or composition similar to a first type of specialized applicator (e.g., blush brush) while the second applicator 112 may have a size, shape, and/or composition similar to a second type of specialized applicator (e.g., eye shadow). To illustrate, the first applicator 110 may be smaller in size relative to the second applicator 112 (or vice-versa). As another example, when both the applicators 110 and 112 include bristles, the applicators 110 and 112 may have a same or a different number of bristles, sizes of bristles, shapes of bristles shapes of holders for the bristles, and the like.

Thus, the pivot mechanism 108 may enable the user to configure the split-tip applicator in two different positions (e.g., with the applicators 110 and 112 adjacent or opposite each other). If the first applicator 110 has a different size relative to the second applicator 112, the two different positions may enable the user to derive three different sized applicators from the split-tip applicator 600, such as a large applicator (e.g., when the applicators 110 and 112 are adjacent to each other), a medium applicator (e.g., the second applicator 112), and a small applicator (e.g., the first applicator 110). For example, in the first position, in which the first applicator 110 is adjacent to the second applicator 112, the split-tip applicator 600 may be used as a large sized applicator due to the combined perimeters of the applicators 110 and 112. In the second position, in which the applicators 110 and 112 are at opposite ends of the split-tip applicator 600, one of the applicators 110 and 112 may be used as a medium sized applicator while the other of the applicators 110 and 112 may be used as a small sized applicator. The applicators 110 and 112 may have different shapes. For example, each of the applicators 110 or 112 may include a fan-shape, a rectangular-shape, a semi-circular shape, a wedge-shape, another type of geometric shape, or any combination thereof. If either or both of the applicators 110 or 112 include brushes, in some cases at least one of the brushes may include a few individual larger bristles than the other bristles in the brush.

The split-tip applicator 600 may be used to apply different products to one or more surfaces. For example, the split-tip applicator 600 may be used to apply different cosmetic products, such as blush, foundation, mascara, eye shadow, etc., to a surface, such as a skin of a human being. The split-tip applicator 600 may, in some cases, include a locking mechanism, as described in FIG. 7. Additionally, in some cases, the split-tip applicator 600 may be placed in a full-retracted position, in which the applicators 110 and 112 are fully retracted into the handle 102, as described in FIG. 2.

Figure 7:
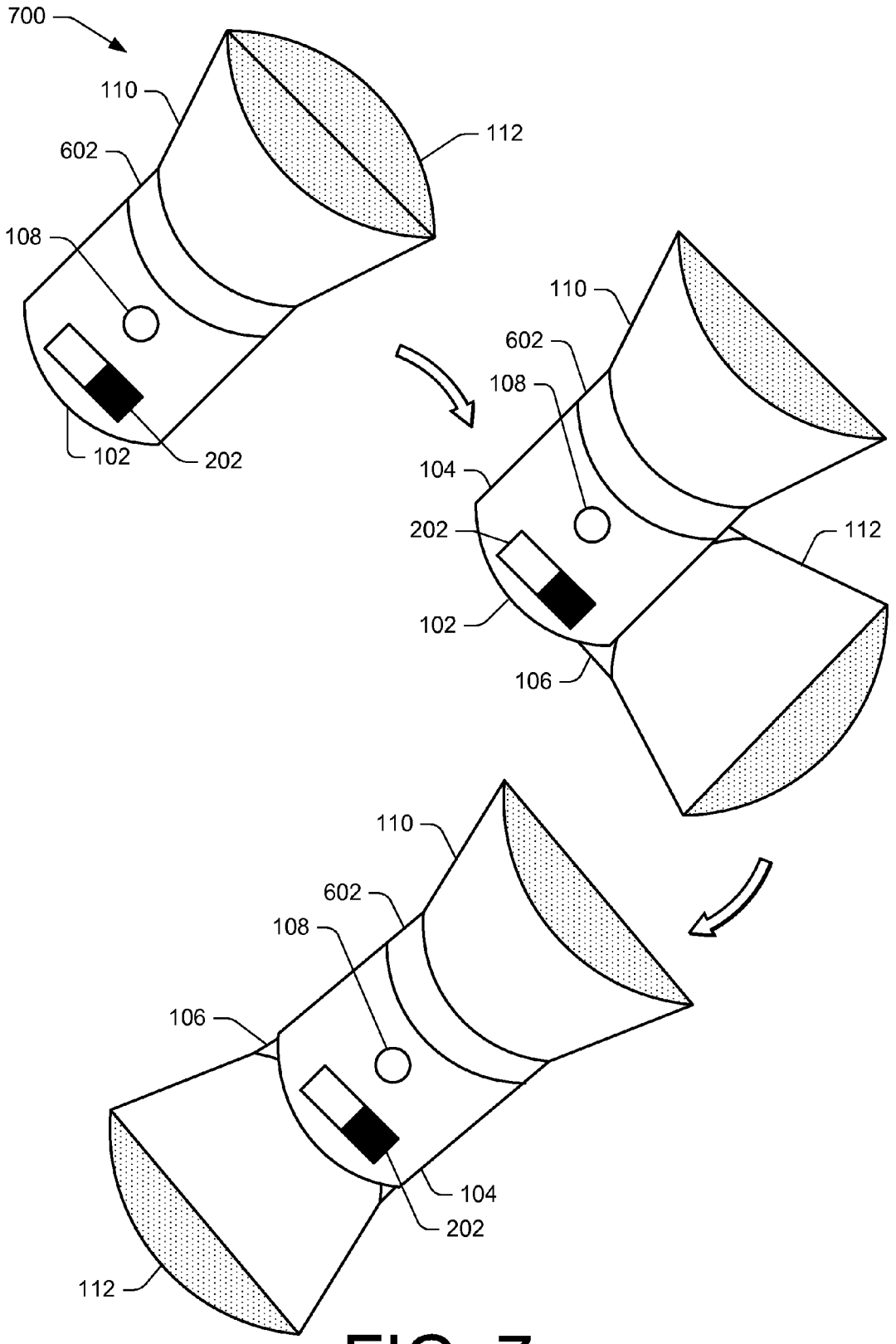
FIG. 7 depicts a fifth illustrative embodiment of a split-tip applicator.

FIG. 7 depicts a fifth illustrative embodiment of a split-tip applicator 700. The split-tip applicator 700 provides a different view (e.g., perspective) of the split-tip applicator 600 of FIG. 6. The split-tip applicator 700 includes the handle 102, the first section 104, the second section 106, and the pivot mechanism 108. The first applicator 110 may be affixed to the first section 104 using the first ferrule 602. The second applicator 112 may be affixed to the second section 106 using a second ferrule (not shown due to the perspective). Each of the first applicator 110 or the second applicator 112 may include one or more of a brush, a sponge, flocking, a comb, or another type of applicator. In some cases, the first applicator 110 may be a same size and/or shape as compared to the second applicator 112. In other cases, the first applicator 110 may be a different size and/or shape as compared to the second applicator 112. For example, as illustrated in FIG. 6, the first applicator 110 and the second applicator 112 may have approximately the same size. After placing the first applicator 110 in a particular position (e.g., adjacent or opposite) relative to the second applicator 112, the locking mechanism 202 may be used to prevent the applicators 110 and 112 from inadvertently moving, similar to the locking mechanism 202 described in FIG. 2.

In some implementations, the applicators 110 or 112 may have a same size, shape, and/or composition (e.g., a brush having multiple bristles, a sponge, a comb, flocking, and the like) while in other implementations, the applicators 110 or 112 may have a different size, shape, and/or composition. For example, the first applicator 110 may have a size, shape, and/or composition similar to a first type of specialized applicator (e.g., blush brush) while the second applicator 112 may have a size, shape, and/or composition similar to a second type of specialized applicator (e.g., eye shadow). To illustrate, the first applicator 110 may be smaller in size relative to the second applicator 112 (or vice-versa). As another example, when both the applicators 110 and 112 include bristles, the applicators 110 and 112 may have a same or a different number of bristles, sizes of bristles, shapes of bristles shapes of holders for the bristles, and the like.

Thus, the pivot mechanism 108 may enable the user to configure the split-tip applicator in two different positions (e.g., where the applicators 110 and 112 are either adjacent or opposite each other). If the first applicator 110 has a different size relative to the second applicator 112, the two different positions may enable the user to derive three different sized applicators from the split-tip applicator 700, such as a large applicator (e.g., when the applicators 110 and 112 are adjacent to each other), a medium applicator (e.g., the second applicator 112), and a small applicator (e.g., the first applicator 110). For example, in the first position, in which the first applicator 110 is adjacent to the second applicator 112, the split-tip applicator 700 may be used as a large sized applicator due to the combined perimeters of the applicators 110 and 112. In the second position, in which the applicators 110 and 112 are at opposite ends of the split-tip applicator 700, one of the applicators 110 and 112 may be used as a medium sized applicator while the other of the applicators 110 and 112 may be used as a small sized applicator. The applicators 110 and 112 may have different shapes. For example, each of the applicators 110 or 112 may include a fan-shape, a rectangular-shape, a semi-circular shape, a wedge-shape, another type of geometric shape, or any combination thereof. If either or both of the applicators 110 or 112 include brushes, in some cases at least one of the brushes may include a few individual larger bristles than the other bristles in the brush.

The split-tip applicator 700 may be used to apply different products to one or more surfaces. For example, the split-tip applicator 700 may be used to apply different cosmetic products, such as blush, foundation, mascara, eye shadow, etc., to a surface, such as a skin of a human being. The split-tip applicator 700 may, in some cases, include a locking mechanism, as described in FIG. 2. Additionally, in some cases, the split-tip applicator 700 may be placed in a full-retracted position, in which the applicators 110 and 112 are fully retracted into the handle 102, as described in FIG. 2.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the split-tip applicator, applicators, locking mechanism, and slide mechanisms may be varied.

What is claimed is:

1. A cosmetic applicator system comprising:

a handle formed of a first section and a second section;

a first brush including a first group of bristles having a first surface area, wherein the first group of bristles is affixed to a top of the first section of the handle;

a second brush including a second group of bristles having a second surface area, wherein the second group of bristles is affixed to the top of the second section of the handle;

the first brush and second brush configured for use each individually or in combination to define a combined brush configuration including the first and second groups of bristles and having a third surface area, wherein the third surface area is defined by the combination of the first surface area of the first brush and the second surface area of the second brush; and a pivot mechanism that enables the first section of the handle to rotate relative to the second section of the handle such that, in a first configuration of the pivot and first and second sections of the handle, the first and second brushes are at opposing ends of the cosmetic applicator system and each usable separately, and in a second configuration of the pivot and the first and second sections of the handle, the first and second brushes are at the same end of the cosmetic applicator and usable in the combined brush configuration; and a locking mechanism to hold the first brush and the second brush in place and to prevent the first section from inadvertently pivoting relative to the second section;

wherein the locking mechanism comprises a protrusion on one of the first section or the second section and a corresponding indent on the other of the second section or the first section and the locking mechanism is in a locked position when the protrusion is positioned inside the corresponding indent.

2. The cosmetic applicator system according to claim 1, wherein the pivot mechanism enables the first brush to be placed adjacent to the second brush.

3. The cosmetic applicator system according to claim 2, further comprising a cap capable of being placed over the first brush and the second brush when the first brush is adjacent to the second brush.

4. The cosmetic applicator system according to claim 1, wherein the pivot mechanism enables the first brush to be placed at an end of the applicator system that is opposite the second brush.

5. The cosmetic applicator system according to claim 1, wherein the first section is pivotable relative to the second section between:

a first position in which the first brush is aligned with the second brush, and a second position in which the first brush is at an opposite end of the applicator system relative to the second brush.

6. The cosmetic applicator system according to claim 1, wherein the combined brush configuration defines a continuous brush perimeter such that the first and second brushes may be used as a single combined brush.

7. The cosmetic applicator system according to claim 1, wherein the first brush and the second brush are different sizes.

8. The cosmetic applicator system of claim 1, wherein the pivot mechanism enables the first section to rotate 180° relative to the second section.

9. A cosmetic applicator system comprising:

a handle formed of a first section and a second section;

a first brush including a first group of bristles having a first surface area, wherein the first group of bristles is affixed to a top of the first section of the handle;

a second brush including a second group of bristles having a second surface area, wherein the second group of bristles is affixed to the top of the second section of the handle;

the first brush and second brush configured for use each individually or in combination to define a combined brush configuration including the first and second groups of bristles and having a third surface area, wherein the third surface area is defined by the combination of the first surface area of the first brush and the second surface area of the second brush;

a pivot mechanism that enables the first section of the handle to rotate relative to the second section of the handle such that, in a first configuration of the pivot and first and second sections of the handle, the first and second brushes are at opposing ends of the cosmetic applicator system and each usable separately, and in a second configuration of the pivot and the first and second sections of the handle, the first and second brushes are at the same end of the cosmetic applicator and usable in the combined brush configuration; and a locking mechanism to hold the first brush and the second brush in place and to prevent the first section from inadvertently pivoting relative to the second section;

wherein:

the locking mechanism comprises a mechanical latch having a locked position and an unlocked position, the locked position securing the first section to the second section, and the unlocked position enabling the first section to rotate relative to the second section via the pivot mechanism.

10. A cosmetic applicator system comprising:

a handle formed of a first section and a second section;

a first brush including a first group of bristles having a first surface area, wherein the first group of bristles is affixed to a top of the first section of the handle;

a second brush including a second group of bristles having a second surface area, wherein the second group of bristles is affixed to the top of the second section of the handle;

the first brush and second brush configured for use each individually or in combination to define a combined brush configuration including the first and second groups of bristles and having a third surface area, wherein the third surface area is defined by the combination of the first surface area of the first brush and the second surface area of the second brush;

a pivot mechanism that enables the first section of the handle to rotate relative to the second section of the handle such that, in a first configuration of the pivot and first and second sections of the handle, the first and second brushes are at opposing ends of the cosmetic applicator system and each usable separately, and in a second configuration of the pivot and the first and second sections of the handle, the first and second brushes are at the same end of the cosmetic applicator and usable in the combined brush configuration; and a locking mechanism to hold the first brush and the second brush in place and to prevent the first section from inadvertently pivoting relative to the second section;

wherein:

the locking mechanism comprises a magnet embedded in a first portion of the first section and a magnetically attractive material embedded in a second portion of the second section, and the locking mechanism is in a locked position when the magnet is positioned adjacent to the magnetically attractive material.

11. A split-tip applicator comprising:

a plurality of applicators including at least a first applicator, and a second applicator;

a handle comprising a plurality of sections including a first section and a second section, the first section having a first end and a second end positioned away from the first end, and the second section having a first end and a second end positioned away from the first end;

the first applicator affixed to the top of the first section at the first end thereof;

the second applicator affixed to the top of the second section at the first end thereof; and a pivot mechanism that enables the first section to rotate relative to the second section by pivotably coupling the first section to the second section; and a plurality of slide mechanisms, each of the plurality of slide mechanisms corresponding to one of the plurality of applicators;

wherein the pivot mechanism allows the first and second applicators to be used individually with the first end of the first section of the handle adjacent to the second end of the second section of the handle; or as a combined applicator with the first and second applicators adjacent to one another.

12. The split-tip applicator according to claim 11, wherein the first section has a same size as compared to at least one other section of the plurality of sections.

13. The split-tip applicator according to claim 11, wherein the first section has a different size as compared to at least one other section of the plurality of sections.

14. The split-tip applicator of claim 11, further comprising a plurality of actuators disposed on an exterior surface of the handle for selectively sliding at least one of the plurality of slide mechanisms to move the corresponding applicator.

15. The split-tip applicator of claim 11, wherein each of the plurality of applicators comprises one or more of a brush, a sponge, a flocking, or a comb.

16. The cosmetic implement according to claim 11 wherein the combined applicator has a single, continuous perimeter for use as a single large applicator.

17. The cosmetic implement according to claim 11 wherein the pivot mechanism attaches to each of the handle sections between the first and second ends thereof.

* * * * *